US008534009B2

(12) United States Patent
Kay

(10) Patent No.: US 8,534,009 B2
(45) Date of Patent: Sep. 17, 2013

(54) SAFETY NOSING COMPONENTS AND MANUFACTURING METHODS

(76) Inventor: Ronald J. Kay, Barrington, IL (US)

( * ) Notice: Subject to any disclaimer, the term of this patent is extended or adjusted under 35 U.S.C. 154(b) by 0 days.

(21) Appl. No.: 13/568,858

(22) Filed: Aug. 7, 2012

(65) Prior Publication Data

US 2012/0297705 A1 Nov. 29, 2012

Related U.S. Application Data

(63) Continuation-in-part of application No. 12/817,617, filed on Jun. 17, 2010, now abandoned, which is a continuation of application No. 12/220,102, filed on Jul. 22, 2008, now abandoned.

(60) Provisional application No. 61/005,739, filed on Dec. 7, 2007.

(51) Int. Cl.
*E04F 11/16* (2006.01)

(52) U.S. Cl.
USPC ..... 52/179; 52/174; 52/28; 362/146; 428/67

(58) Field of Classification Search
USPC ..... 52/179, 174, 312, 287.1, 28, 366, 52/389; 40/584, 594, 606.01, 541, 542; 362/146; 428/67, 172, 690
See application file for complete search history.

(56) References Cited

U.S. PATENT DOCUMENTS

| | | | | | |
|---|---|---|---|---|---|
| 966,133 | A | * | 8/1910 | Staples | 52/179 |
| 2,288,470 | A | * | 6/1942 | Lorraine | 52/179 |
| 3,334,456 | A | * | 8/1967 | Naka | 52/179 |
| 4,058,942 | A | * | 11/1977 | Naka | 52/179 |
| 4,060,947 | A | * | 12/1977 | Naka | 52/179 |
| 4,321,293 | A | * | 3/1982 | Naka | 428/60 |
| 4,394,714 | A | * | 7/1983 | Rote | 362/576 |
| 4,486,987 | A | * | 12/1984 | Naka | 52/179 |
| 4,504,168 | A | * | 3/1985 | Miller | 403/353 |
| 4,522,861 | A | * | 6/1985 | Dunsworth | 428/192 |
| 4,905,431 | A | * | 3/1990 | Davis | 52/179 |
| 4,985,095 | A | * | 1/1991 | Riddle | 156/64 |
| 4,998,391 | A | * | 3/1991 | Connew | 52/179 |
| 5,022,198 | A | * | 6/1991 | Lower | 52/105 |
| 5,051,289 | A | * | 9/1991 | Riddle | 428/77 |
| 5,103,608 | A | * | 4/1992 | Andreo | 52/179 |
| 5,176,239 | A | * | 1/1993 | Findlay et al. | 198/321 |
| D345,878 | S | * | 4/1994 | Garon | D6/583 |
| 5,587,218 | A | * | 12/1996 | Betz | 428/67 |
| 5,724,909 | A | * | 3/1998 | Pitman et al. | 116/202 |
| 5,775,016 | A | * | 7/1998 | Chien | 40/544 |
| 5,898,814 | A | * | 4/1999 | Yamamoto | 385/147 |
| 5,904,017 | A | * | 5/1999 | Glatz et al. | 52/287.1 |
| 5,961,072 | A | * | 10/1999 | Bodle | 244/118.5 |
| 6,041,533 | A | * | 3/2000 | Lemmond, Jr. | 40/584 |
| 6,082,870 | A | * | 7/2000 | George | 362/146 |
| 6,237,266 | B1 | * | 5/2001 | Tassey et al. | 40/542 |

(Continued)

FOREIGN PATENT DOCUMENTS

GB 2234539 A * 2/1991

*Primary Examiner* — Robert Canfield
*Assistant Examiner* — Babajide Demuren
(74) *Attorney, Agent, or Firm* — Valauskas Corder LLC

(57) ABSTRACT

The present invention is an improved safety nosing component including a base element with channel member and a light emission element. The safety nosing component is manufactured by extrusion, co-extrusion, triple-extrusion, injection molding, insert injection molding, two-shot molding or a combination thereof. The present invention allows safety nosing components to be installed on architectural structures while also providing additional functionality.

12 Claims, 5 Drawing Sheets

(56) References Cited

U.S. PATENT DOCUMENTS

| | | | | |
|---|---|---|---|---|
| 6,276,634 | B1 * | 8/2001 | Bodle | 244/118.5 |
| 6,554,446 | B1 * | 4/2003 | Walsh et al. | 362/146 |
| 6,775,937 | B2 * | 8/2004 | Ruana | 40/660 |
| 6,854,163 | B1 * | 2/2005 | Ruana | 16/431 |
| 6,908,653 | B2 * | 6/2005 | Keane | 428/40.1 |
| 7,155,849 | B2 * | 1/2007 | Hinterkeuser | 40/560 |
| 7,216,447 | B2 * | 5/2007 | Bateman | 40/618 |
| 2001/0013185 | A1 * | 8/2001 | Chien | 40/544 |
| 2003/0194538 | A1 * | 10/2003 | Keane et al. | 428/187 |
| 2004/0134107 | A1 * | 7/2004 | Hinterkeuser | 40/584 |
| 2004/0216344 | A1 * | 11/2004 | Bateman | 40/611.05 |
| 2005/0271883 | A1 * | 12/2005 | Leu et al. | 428/424.2 |

* cited by examiner

SAFETY NOSING COMPONENTS AND MANUFACTURING METHODS

This application is a continuation-in-part of U.S. patent application Ser. No. 12/817,617 filed Jun. 17, 2010, which is a continuation of U.S. patent application Ser. No. 12/220,102 filed Jul. 22, 2008 which claims the benefit of U.S. Provisional Patent Application Ser. No. 61/005,739 filed Dec. 7, 2007.

FIELD OF THE INVENTION

The present invention relates generally to safety components and more particularly to nosing components for architectural structures and improved manufacturing thereof.

BACKGROUND OF THE INVENTION

Safety devices are used on architectural structures in a variety of environments to reduce risk. Many environments exist where various poor lighting scenarios occur, for example, dimmed lighting or darkness due to a power failure or smoke resultant from a fire. Risks may occur when people attempt to navigate in poorly lit environments; such risks include physical injury, lack of orientation, lack of information regarding navigation and lack of familiarity with the environment. To mitigate these risks, illuminated safety devices exist that are typically installed on stairs, floors, walls, and handrails such as that disclosed in application Ser. No. 12/215,971 filed Jul. 1, 2008, entitled Safety Handrail Apparatus and Manufacturing Methods, incorporated herein by reference.

But, these prior art devices are deficient in several respects including limitations in design, manufacturability and functionality. One limitation is due in part to material compositions of the device. For example, U.S. Pat. No. 4,522,861 requires a material mixture including zinc sulfide, copper phosphorescent pigment, bleached aluminum oxide and silicon carbide; U.S. Pat. No. 5,904,017 requires a material including a transparent resin mixed with zinc sulfide particles; and U.S. Pat. No. 5,103,608 requires lumilux-N pigment carried by a two part epoxy.

Another limitation of the prior art devices is due in part to material requirements such as an adhesive. For example, U.S. Pat. No. 6,632,506 requires traction tape with an adhesive; and U.S. Pat. No. 4,360,557 requires a laminate with a pressure sensitive adhesive.

Yet another limitation of the prior art devices is due in part to inflexibility in design, which further results in costly and time-consuming manufacturing. For example, U.S. Pat. No. 5,898,814 includes a device with multiple parts including an illuminating plane to emit light that is reflected by a reflecting member; U.S. Pat. No. 4,058,942 includes a device that requires a transparent covering strip positioned over a fluorescent material strip; and U.S. Pat. No. 6,554,446 includes a device that requires electrically activated light sources such as seat-mounted lamps, or beacon lamps.

These prior art devices are limited in functionality by only serving as a safety device. There is a desire for improved safety nosing components that provide other functionality, for example, a non-slip surface, dock boat bumper, illumination guide, an illuminated boat fender or advertising medium.

While the prior art devices fulfill their respective particular objectives and requirements, the need still remains for safety nosing components and manufacturing methods thereof that fulfill the deficiencies of these devices and provide additional functionality. The present invention satisfies this need.

SUMMARY OF THE INVENTION

The improved safety nosing component and methods of the present invention fulfill the deficiencies in design, manufacturability and functionality of prior art devices. The present invention includes improved material compositions and material requirements. Additionally, the present invention is flexible in design thereby reducing cost and time associated with manufacturing. Embodiments according to the present invention contemplate one-step, two-step, or three-step manufacturing processes. Certain embodiments of the present invention may also provide functionality in addition to a visual safety marker.

For purposes of this application, an architectural structure is any physical formation. The present invention is discussed herein with respect to steps, decks and docks, but any physical formation is contemplated such as floors, walls, ceilings, piers, decks, balconies, hallways, bridges, wharfs, landings, platforms, fences, ladders, stairways, escalators, elevators, parking lots, boats, ships, planes, automobiles, and arenas just to name a few. It is further contemplated the present invention can be the architectural structure itself such as a stake or post, for example, a deck post and sign post.

The safety nosing component may be attached to an architectural structure of any construction, such as wood, composite wood, cement, fiberglass, plastic, metal, concrete, steel, stone, brick, glass, asphalt, carpet to name a few. The safety nosing component may be portable or permanently secured to an architectural structure such as by using hardware including screws or nails, adhesive including liquid or tape adhesive, or Velcro®. The safety nosing component may further include an attachment member to assist with securement to an architectural structure.

In one embodiment, the safety nosing component according to the present invention includes a base element and a photoluminescent light emission element. Additional embodiments may further include a substrate element.

The base element, in one embodiment, includes a main member with an inside surface, outside surface, first edge, second edge, third edge and fourth edge. It is contemplated any of the edges of the main member may include a bevel feature, for example, to prevent shoes or feet from catching on the safety nosing component. According to the present invention, the base element may be any length, width, depth, shape or size. For example, in one embodiment, the base element may be about and including 3 feet to about and including 12 feet in length. In another embodiment, the base element may be about and including 20 feet or greater in length.

In another embodiment, the base element includes a main member as described above as well as a support member. The support member includes an interior surface, exterior surface, first border, second border, third border and fourth border. It is contemplated any of the borders of the support member may include a bevel feature, for example, to prevent shoes or feet from catching on the safety nosing component. The main member and support member unite at an edge of the main member and a border of the support member. The main member and support member are united such as to form approximately a ninety-degree angle between the two elements, although any angle resultant from the application of the safety nosing component is contemplated.

In another embodiment of the present invention, an edge of the main member and a border of the support member are united via a living hinge member. A living hinge member is a thin flexible hinge that may be formed during manufacturing such as by injection molding or may be a separate part such as a thin strip of material, such as thermoset or thermoplastic resin, polyethylene or polypropylene, that is molded into the component to create a line along which the component can bend. Properly designed and executed, the living hinge member can be closed and opened over the life of the component with little or no loss of function.

The base element includes a channel member extending from a proximate end to a distal end and is formed by boundaries. The channel member may be positioned on either the main member or support member of the base element. More specifically, the channel member may be positioned on the outside surface of the main member or the exterior surface of the support member. The channel member may run along the entire length or a portion of the entire length of the outside surface of the main member or exterior surface of the support member.

Any depth of the channel member is contemplated in order to receive the light emission element. It is further contemplated that the channel member can be any cross-sectional shape such as dovetail, triangular, square, to name a few. The channel member may be, for example, about and including ½ inches to about and including 2½ inches in width.

The light emission element is any length, width, depth, shape or size for positioning within the channel member of the base element. The light emission element stores energy, for example, as by absorbing photons and releasing the energy as light over a duration of time. The light emission element is capable of producing a sustained visible glow including in darkness such as at a minimum of one hour or longer. According to the present invention, the light emission element is a material with a fluorescent or photoluminescent quality, for example, strontium oxide, strontium aluminate, strontium silicate with magnesium or metal sulfides such as calcium sulfide, strontium sulfide, zinc sulfide, and cadmium sulfide. The light emission element may further be a metal or polymer.

The base element and light emission element of the present invention are made of any material that can be molded or extruded, for example metal such as aluminum or powdered metals, composite lumber, and polymers, thermoset or thermoplastic resins. Polymers include plastics such as thermoplastic, thermoset plastic, polyurethane, polyethylene, polypropylene and engineering plastic, for example, synthetic polymers including nylon. The materials may further be compounded with a glass fiber or powdered metal to maintain rigidity such that the component does not warp or twist during manufacturing or installation.

The material used for the safety nosing component is easily cut, for example on a table saw or miter saw, to form various configurations such as to accommodate varying lengths or corners. It is further contemplated that the material may be cured by a radiation source such as ultraviolet (UV) light or contain a UV additive in the material. Additionally, the material may be impact modified to improve the material properties such as wear, non-slip, and weatherability, for example 2000 kilojewels of weatherability. The material may also be compounded with a flame retardant additive to meet certain fire codes and regulations.

The materials used to manufacture the present invention may further be compounded with any color concentrate. This contemplates color matching, such as deck stains, paints, and composite lumber colors. The entire safety nosing component may be manufactured with any color concentrate, including those that emit light such that the entire component illuminates.

In another embodiment of the present invention, the safety nosing component further includes a substrate element. The substrate element includes a top face and a bottom face along with a first side, second side, third side and fourth side. The substrate element according to the present invention is made of any material that can be molded or extruded, for example metal such as aluminum, or polymers. Additionally, the substrate element may include a substance such as a film, pad, metal, grit or tape such as a pre-finished, cut to size, non-skid friction substance and may further include a self adhesive backing used in co-extrusion or triple-extrusion processes. The substrate element is any length, width, depth, shape or size to be positioned adjacent to the light emission element. The advantages of a substrate element are that it may optimize the illumination of the light emission element by preventing the base element from "bleeding through" the light emission element. In a preferred embodiment, the substrate element is white although any color is contemplated to achieve the advantages discussed herein.

For purposes of this application, the term "light emission element" used herein may include either the light emission element or the light emission element including substrate element.

The light emission element includes an upper face and a lower face along with a first wall, second wall, third wall, and fourth wall. Although numerous configurations are contemplated, in a preferred embodiment the light emission element, is positioned substantially about the channel member and is about and including ½ inches to about and including 2½ inches in width and runs along the entire length or a portion of the entire length of the channel member.

In another embodiment, the present invention allows configuration into any desired length or shape by interconnecting any number of individual nosing components. For example, a first nosing component may be interconnected to a second nosing component and so on to form a continuous linear component or to form a corner component for architectural structures with bends or curves. Interconnection includes insert injection molding, overmolding, heat stake, weld, snap fit such as annular snap fit or cantilever snap fit, adhesive, adhesive tape, fasteners, chemical bonding, mechanical fit, or interference fit. For purposes of this application, the term "weld" includes sonic weld, vibration weld, orbital weld, ultrasonic weld, frictional weld, spin weld, radio frequency weld and laser weld, to name a few.

The present invention is manufactured by extrusion, co-extrusion, triple-extrusion, injection molding, insert injection molding, or two-shot molding. Extrusion is a process for manufacturing wherein material is pushed or drawn through a die in the desired shape of a fixed cross-sectional profile of the component. The component is cooled and solidified as it is pulled through the die. According to the present invention, the base element, the substrate element and light emission element may each be extruded.

Co-extrusion is the manufacturing process of extruding two or more materials through a single die with two or more orifices arranged so that the two or more materials, which may further be of different color, merge and weld together. Each material is fed to the die from a separate extruder, but the orifices may be arranged so that each extruder supplies two or more plies. Each ply may be of the same material, or each ply may be of different materials such as one ply of a polymer material and the other ply of a non-skid friction substance that is co-extruded upon the polymer material. In one embodiment according to the present invention, the base element and the light emission element are co-extruded using two plies to achieve the safety nosing component. In another embodiment, the base element and the substrate element are co-extruded. In yet another embodiment, the light emission component and substrate element are co-extruded.

Triple-extrusion is the manufacturing process similar to co-extrusion, except that three or more materials are extruded through a single die with three or more orifices arranged so that the three or more materials merge and weld together. The three or more materials of a triple-extrusion process may each be of different color or may each be of different material. Each material is fed to the die from a separate extruder, but the orifices may be arranged so that each extruder supplies three or more plies. Each ply may be of the same material, or each ply may be of different materials, for example, one ply of a photoluminescent polymer, one ply of aluminum, and one ply of a different material, such as a non-skid friction substance, tape substance, shiny metal, or a white polymer. An embodiment according to the present invention includes triple-extruding the base element, substrate element and light emission element.

It is also contemplated that the elements of the present invention can include a texture element created by a calendering process during the extrusion, co-extrusion, or triple-extrusion process. Calendering includes a series of hard or heat-treated pressure rollers used to create a texture element, for example on the outside surface of the main member of the base element, the exterior surface of the support member of the base element, the upper face of the light emission element, or top face of the substrate element. A texture element includes, for example, cleats, ridges, or grooves to form a non-slip surface tread, dock illumination guide, dock bumper, a boat fender or advertising constituent. An advertising constituent may be the advertisement itself or a pocket for receiving an advertisement. The embodiments of the present invention that include a dock bumper provide additional functionality of cushioning an impact of an incoming water vessel. The embodiments of the present invention that include an advertising constituent provides additional functionality of an advertising medium. For example, an advertisement may be positioned on or within the base element or light emission element. An advertisement may even be positioned on or within the substrate element.

It is further contemplated that the elements of the present invention can include a texture element created by a laser etched detail during injection molding, insert injection molding, or two-shot molding.

Injection molding is a manufacturing process for making components by injecting materials at high pressure into a mold shaped as the inverse of the desired shape of the component. In one embodiment, the base element and light emission element are individually injection molded. In another embodiment, the base element, substrate element and light emission element are individually injection molded. The elements are then interconnected.

Interconnection includes insert injection molding, overmolding, heat stake, weld, snap fit such as annular snap fit or cantilever snap fit, adhesive, adhesive tape, fasteners, chemical bonding, mechanical fit, or interference fit. For purposes of this application, the term "weld" includes sonic weld, vibration weld, orbital weld, ultrasonic weld, frictional weld, spin weld, radio frequency weld and laser weld, to name a few.

It is also contemplated that certain elements are extruded and others are injection molded after which the elements are interconnected. For example, the base element is extruded and the light emission element is injection molded or the base element is injection molded and the light emission element is extruded. Other examples include a co-extruded base element and substrate element and an injection molded light emission component, or a co-extruded light emission element and substrate element and an injection molded base element.

Insert injection molding is a manufacturing process that includes an insert part that is placed into the mold cavity prior to injecting material to encapsulate the insert part. According to the present invention, the insert part may be the base element, the light emission element, the light emission element and substrate element, or the base element and substrate element. The insert part may be manufactured, for example, by extrusion, co-extrusion, injection molding, or even formed applications wherein a malleable material such as metal is formed into a desired any length, width, depth, shape or size. In one embodiment, the insert part is the base element such that the light emission element or light emission element and substrate element is injected molded to encapsulate the insert part. For example, the light emission element is insert injection molded into an aluminum metal base element. In another embodiment, the insert part is the light emission element such that the base element or base element and substrate element is injected molded to encapsulate the insert part. In another embodiment, the insert part is the light emission element and substrate element such that the base element is injected molded to encapsulate the insert part. In yet another embodiment, the insert part is the base element and substrate element such that the light emission element is injected molded to encapsulate the insert part.

Two-shot injection molding allows the production of a component from two different materials, which may further be of different color, at the same time during one machine cycle. The two different materials may be joined to form the component, for example, through a heat and pressure process or bonded through mechanical interference. In one embodiment, the base element and light emission element are manufactured with a two-shot injection molding process. In another embodiment, the base element and substrate element are two-shot injection molded. In yet another embodiment, the substrate element and light emission element are two-shot injection molded.

In one embodiment of the present invention, the safety nosing component is overmolded, otherwise referred to as in-molded. Overmolding improves efficiency and can be achieved with injection molding, insert injection molding, or two-shot molding manufacturing processes. With overmolding, only one element of the component is molded in one material, and that element is manipulated so an additional material can be molded around, over, under, or through it to complete the final component.

In embodiments that include a substrate element, the light emission element and substrate element may be manufactured using extrusion, co-extrusion, injection molding, insert injection molding and two-shot injection molding. The light emission element including substrate element are then assembled with the base element such as by insert injection molding. In embodiments where the base element is manufactured via extrusion, injection molding, or insert injection molding, the light emission element including substrate element are interconnected to the base element. Again, interconnection includes insert injection molding, overmolding, heat stake, weld, snap-fit such as annular snap fit or cantilever snap fit, adhesive, adhesive tape, fasteners, chemical bonding, mechanical fit, or interference fit.

Other embodiments include separately manufacturing each of the base element, light emission element and substrate element such as by extrusion, injection molding or insert injection molding. Then, the light emission element, substrate element and base element are interconnected.

Yet other embodiments may include manufacturing the base element and substrate element such as by co-extrusion, injection molding, insert injection molding, or two-shot molding. The light emission element may then be assembled with the base element such as by insert injection molding. In embodiments where the light emission element is manufactured via extrusion, injection molding, or insert injection molding, the light emission element is interconnected to the base element including substrate element.

Yet other embodiments may include a base element of a malleable material such as aluminum that can manufactured using forming processes. The light emission element may then be interconnected on the base element. Metal forming processes include: stamping, bending, spinning, stretching, drawing, ironing, wheeling, roll forming, and incremental sheet forming.

Other embodiments may include co-extruding a polymer material and a non-skid friction substance such that the non-skid friction substance only covers a portion of the polymer material. The co-extruded non-skid friction substance and polymer material are insert molded into the base element, wherein the base element overmolds the portion of the polymer material without the non-skid friction substance such that the non-skid friction substance is flush with the base element.

An object of the present invention is to provide an improved safety nosing component that complies with all current and future contemplated industry standards and specifications, including Property Services Agency (PSA), International Building Code (IBC), National Fire Protection Association (NFPA), International Code Compliance (ICC), American National Standards Institute (ANSI), International Residential Code (IRC), and American with Disabilities Act (ADA).

Yet another object of the present invention is to reduce risks that may occur when people attempt to navigate in poorly lit environments. The present invention provides components that function as a safety egress or ingress pathway to quickly evacuate people in the case of an emergency.

Another object of the present invention is to provide components that serve additional functions such as a non-slip surface, dock bumper for boats, illumination guide, an illuminated boat fender or advertising medium.

Another object of the present invention is to provide a safety nosing component manufactured by extrusion, co-extrusion, triple-extrusion, injection molding, insert injection molding, two-shot injection molding, or any combination thereof.

Yet another object of the present invention is to provide an interconnecting safety nosing component system. The present invention contemplates any configuration by interconnecting any number of individual nosing components.

Yet another object of the present invention is to provide a safety nosing component that requires little to no maintenance.

Yet another object of the present invention is to provide a light emission element that does not lift or peel away from the substrate element or the base element.

Yet another object of the present invention is to provide a manufacturing process for a component comprising compatible materials as well as a component comprising non-compatible materials.

Another object of the present invention is to protect architectural structures from wear and maintenance regardless of substance, e.g., such as wood, composite wood, cement, fiberglass, metal, concrete, steel, stone, brick, glass, asphalt, carpet.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will be described in conjunction with the appended drawings provided to illustrate and not to the limit the invention, where like designations denote like elements, and in which.

DESCRIPTION OF PREFERRED EMBODIMENTS

Preferred embodiments of a protective flooring device according to the present invention are generally shown by referring to the accompanying drawings.

Figure 1:
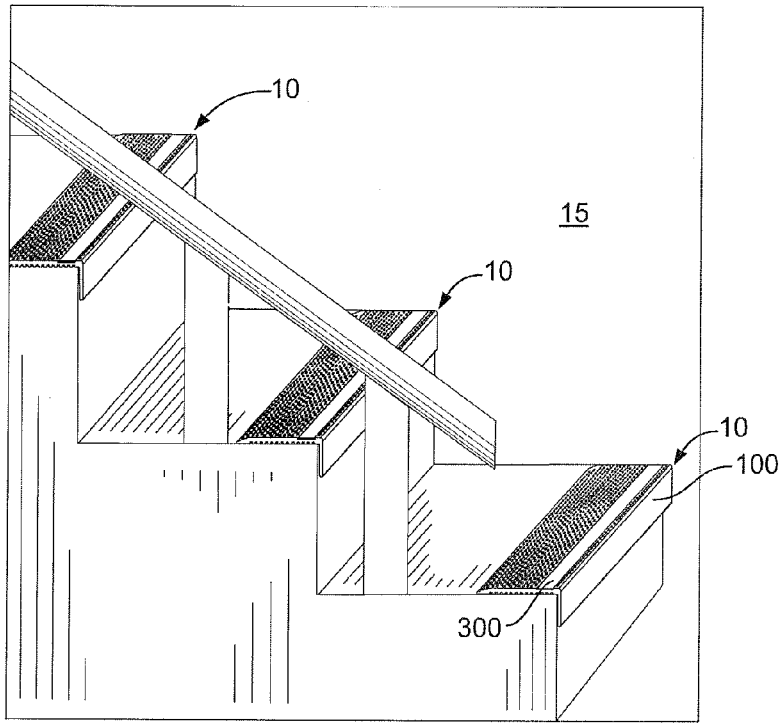
FIG. 1 is a perspective view of a safety nosing component shown as a stair nosing component in accordance with one embodiment of the present invention.
Figure 2:
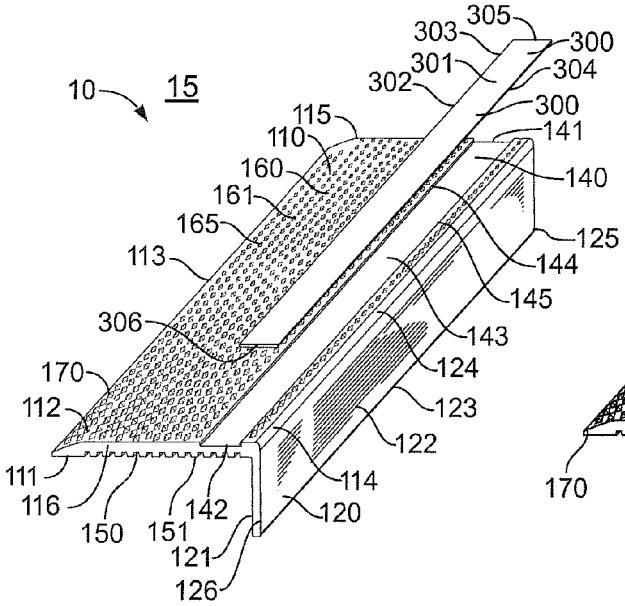
FIG. 2 is an exploded perspective view of a base element and light emission element of a safety nosing component in accordance with an embodiment of the present invention.
Figure 3:
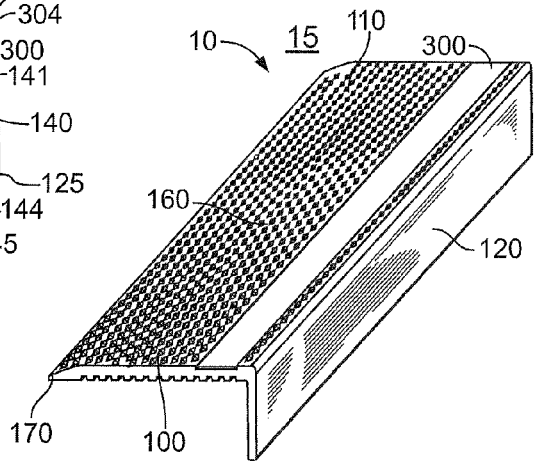
FIG. 3 is an assembled perspective view of a base element and light emission element of the safety nosing component of FIG. 2 according to the present invention.
Figure 4:
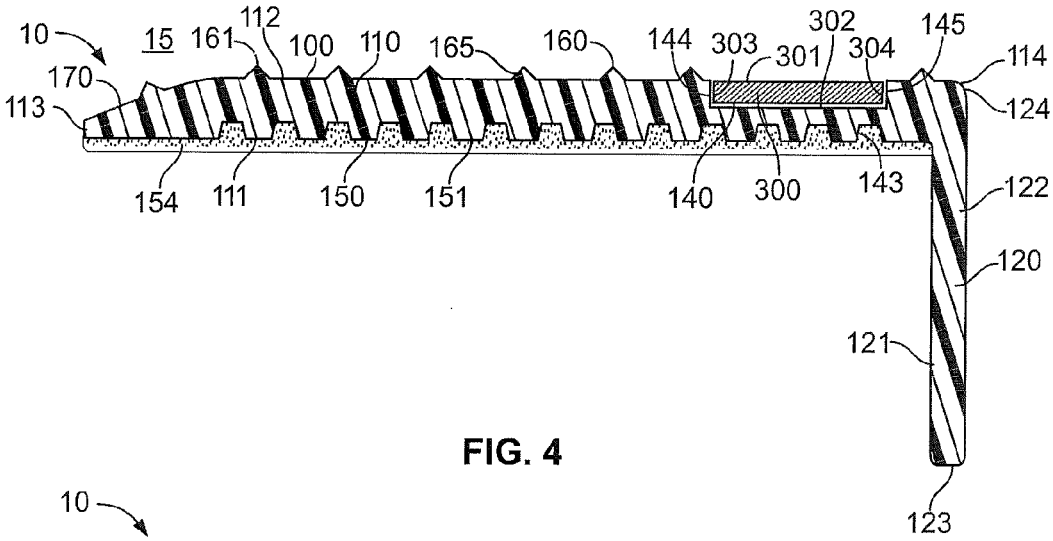
FIG. 4 is a side view of a base element and light emission element of the safety nosing component of FIG. 2 according to the present invention.
Figure 5A:
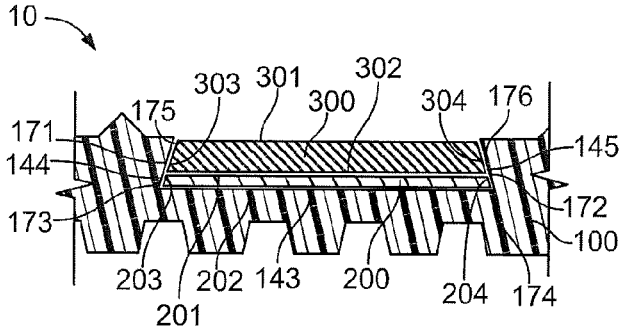
FIG. 5A is a side view of a base element and light emission element including substrate element of a safety nosing component in accordance with an embodiment of the present invention.
Figure 5B:
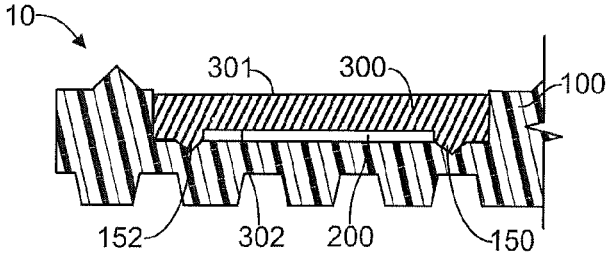
FIG. 5B is a side view of a base element and light emission element including substrate element of a safety nosing component in accordance with another embodiment of the present invention.
Figure 5C:
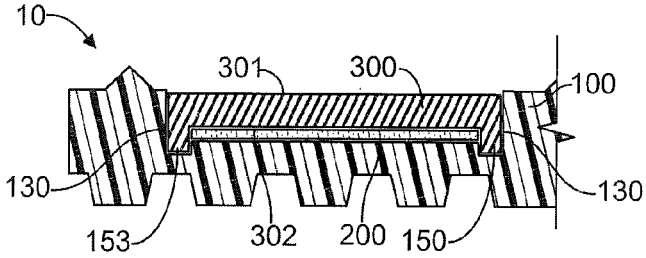
FIG. 5C is a side view of a base element and light emission element including substrate element of a safety nosing component in accordance with another embodiment of the present invention.

A safety nosing component 10 is shown in FIG. 1 as stair nosing component 15 in accordance with one embodiment of the present invention. As shown in FIG. 1, FIG. 2, FIG. 3 and FIG. 4, the stair nosing component 15 according to the present invention includes a base element 100 and light emission element 300. Additional embodiments may further include a substrate element 200 as shown in FIG. 5A, FIG. 5B and FIG. 5C.

In FIG. 1, FIG. 2, FIG. 3 and FIG. 4, the base element 100 includes a main member 110 with an inside surface 111, outside surface 112, first edge 113, second edge 114, third edge 115 and fourth edge 116.

In this embodiment, the base element 100 includes a main member 110 as described above as well as a support member 120. The support member 120 includes an interior surface 121, exterior surface 122, first border 123, second border 124, third border 125 and fourth border 126. As shown, the main member 110 and support member 120 unite at the second edge 114 of the main member 110 and the second border 124 of the support member 120, although uniting any edge or border is contemplated. The main member 110 and support member 120 are united such as to form approximately a ninety-degree angle between the inside surface 111 of the main member 110 and the interior surface 121 of the support member 120, although any angle is contemplated.

The outside surface 112 of the main member 110 further includes a texture element 160, shown here as cleats 161 to form tread 165 to serve as a non-slip surface. It is contemplated the texture element 160 may further form an advertisement element as described more fully with respect to FIG. 10.

As shown, the inside surface 111 of the main member 110 includes an attachment member 150, although it is contemplated the support member 120 may include an attachment member. The attachment member 150 as shown is a conduit structure 151. In this embodiment, adhesive 154 is applied to the conduit structure 151 to secure the safety nosing component 10 to an architectural structure.

Figure 9:
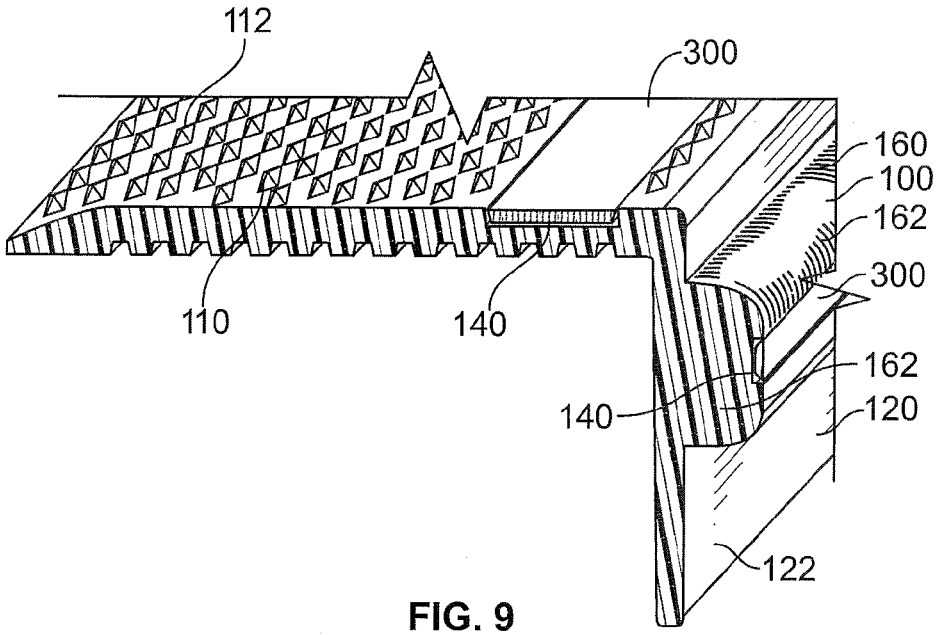
FIG. 9 is a side view of a base element and light emission element of a safety nosing component with additional functionality as a dock bumper and illumination guide for incoming water vessels in accordance with an embodiment of the present invention.

The base element 100 includes a channel member 140 extending from a proximate end 141 to a distal end 142. The channel member 140 may be positioned on either the main member 110 as shown, or on the support member 120 of the base element 100 as shown in FIG. 9. More specifically, the channel member 140 is positioned on the outside surface 112 of the main member 110 as shown, or on the exterior surface 122 of the support member 120 as shown in FIG. 9.

As shown in FIG. 1, FIG. 2, FIG. 3 and FIG. 4, channel member 140 runs along the entire length of the outside surface 112 of the main member 110 formed by a first boundary 143, second boundary 144 and third boundary 145 between a proximate end 141 and distal end 142. The channel member 140 is positioned such that the proximate end 141 and distal end 142 are located on the third edge 115 and fourth edge 116 respectively, although it is contemplated the proximate end 141 and distal end 142 may be located on the first edge 113 and second edge 114 respectively. As shown, the first edge 113 includes a bevel feature 170.

The light emission element 300 includes an upper face 301 and a lower face 302 along with a first wall 303, second wall 304, third wall 305, and fourth wall 306. The light emission element 300 is positioned substantially about the channel member 140 such that the lower face 302 of the light emission element 300 abuts the first boundary 143 of the channel member 140. Additionally, the first wall 303 abuts the second boundary 144 and the second wall 304 abuts the third boundary 145 such that the proximate end 141 and the distal end 142 of the channel member 140 align with the third wall 305 and the fourth wall 306 of the light emission element 300 respectively.

As shown in FIG. 5A, FIG. 5B and FIG. 5C, the base element 100 of the safety nosing component 10 further includes a substrate element 200. The substrate element 200 includes a top face 201 and a bottom face 202 along with a first side 203, second side 204, third side 205 and fourth side 206.

FIG. 5A is a side view of a base element 100 and light emission element 300 including substrate element 200 of a safety nosing component 10 in accordance with an embodiment of the present invention. As shown, the substrate element 200 is positioned substantially about the channel member 140 such that it is located between the base element 100 and the light emission element 300. The bottom face 202 of the substrate element 200 abuts the first boundary 143 of the channel member 140 and the top face 201 of the substrate element 200 abuts the lower face 302 of the light emission element 300. Further, the third side 205 of the substrate element 200 aligns with the proximate end 141 of the channel member 140 and the third wall 305 of the light emission element 300. Likewise, the fourth side 206 of the substrate element 200 aligns with the distal end 142 of the channel member 140 and the fourth wall 306 of the light emission element 300.

In this embodiment, the channel member 140 has a second boundary 144 including a bevel feature 171 and a third boundary 145 with a bevel feature 172. Additionally, the first side 203 and the second side 204 of the substrate element 200 include reverse-bevel features 173 and 174 respectively. The first wall 303 and the second wall 304 of the light emission element 300 also include reverse-bevel features 175 and 176 respectively. The bevel features mate with the reverse-bevel features in order to overmold the base element 100. This secures the substrate element 200 and the light emission element 300 within the channel member 140 of the base element 100.

FIG. 5B is a side view of a base element 100 and light emission element 300 including substrate element 200 of a safety nosing component 10 in accordance with another embodiment of the present invention. As shown, the light emission element 300 includes an attachment member 150 on the lower face 302. The attachment member 150 as shown is a pair of stake structures 152.

FIG. 5C is a side view of a base element 100 and light emission element 300 including substrate element 200 of a safety nosing component 10 in accordance with another embodiment of the present invention. As shown, the light emission element 300 includes an attachment member 150 on the lower face 302. The attachment member 150 as shown is a pair of pin structures 153.

In the embodiment of FIG. 5B, the stake structures 152 assist in assembling the light emission element 300, substrate element 200 and base element 100 by interconnecting the elements via heat staking. In the embodiment of FIG. 5C, the base element 100 further includes aperture members 130. The pin structures 153 assist in assembling the light emission element 300, substrate element 200 and base element 100 by interconnecting the pin structures 153 with the aperture members 130 via welding. It is also contemplated that interconnection may be performed via snap-fit, adhesive, adhesive tape, chemical bonding, mechanical fit, or interference fit.

Figure 6:
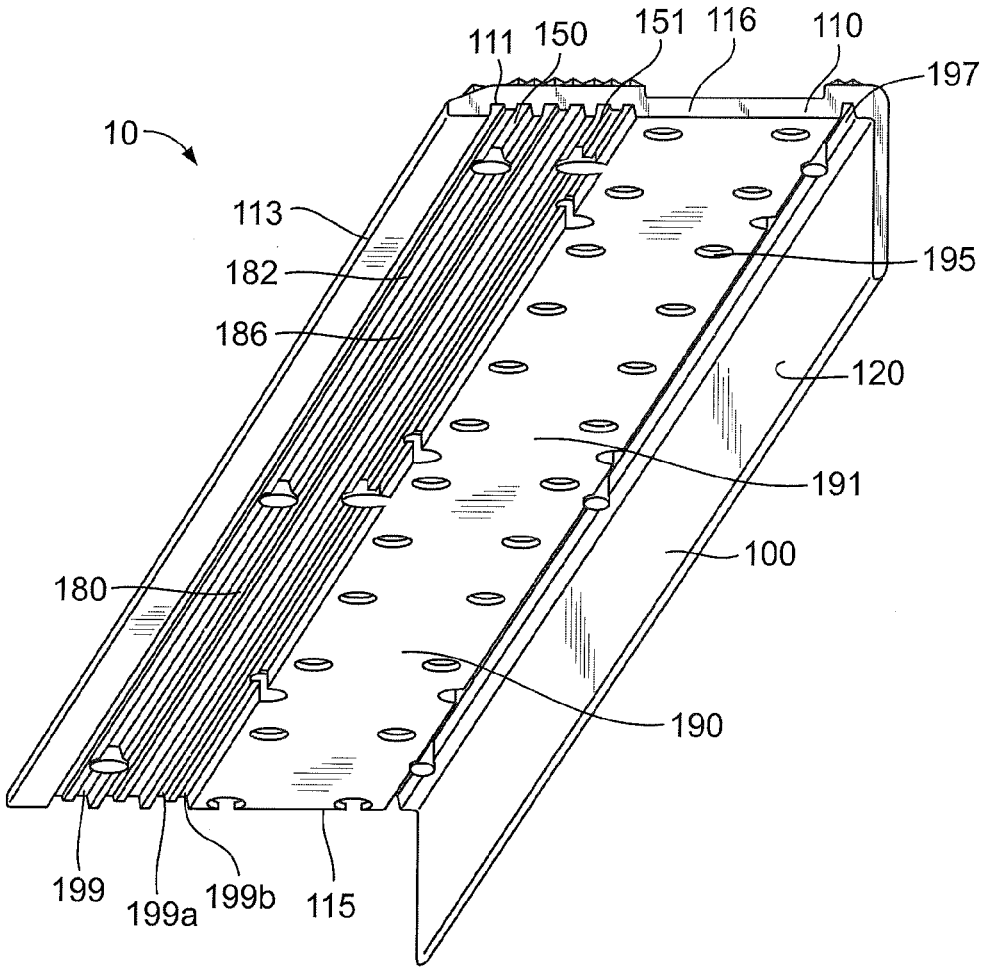
FIG. 6 is a bottom view of the base element of the safety nosing component according to one embodiment of the present invention.
Figure 7:
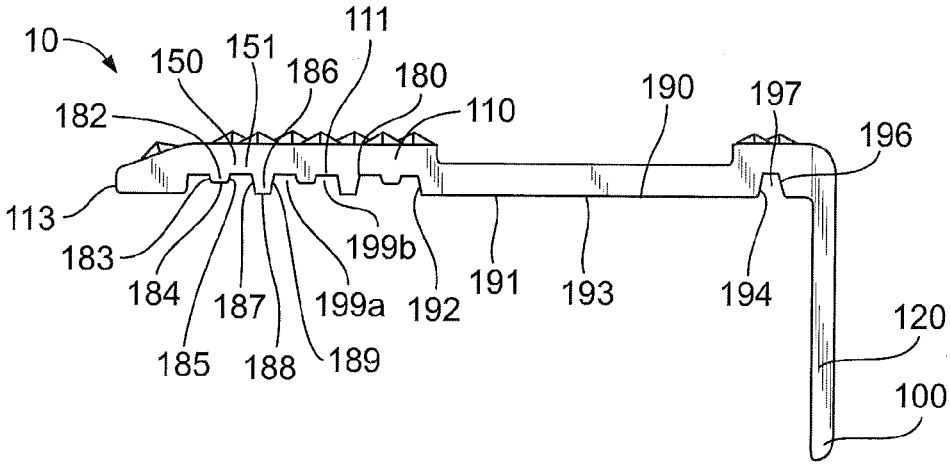
FIG. 7 is a side view of a base element of the safety nosing component of FIG. 6 according to the present invention.

FIG. 6 illustrates a bottom view of the base element 100 of the safety nosing component 10 and FIG. 7 illustrates a side view of the base element 100 of the safety nosing component 10 of FIG. 6.

As shown in FIG. 6 and FIG. 7, the conduit structure 151 of the attachment member 150 on the inside surface 111 of the main member 110 is defined by a nodular portion 180 and a planar portion 190.

The nodular portion 180 includes one or more continuous parallel lower ribs 182 and one or more continuous parallel extended ribs 186. Each lower rib 182 protrudes from the inside surface 111 and is defined by first perimeter surface 183, a second perimeter surface 184, and a third perimeter surface 185. Each extended rib 186 protrudes from the inside surface 111 and is defined by a first perimeter border 187, a second perimeter border 188, and a third perimeter border 189. The extended rib 186 protrudes past the lower rib 182 as measured from the inside surface 111.

The perimeter surfaces 183, 185 of the lower ribs 182 and perimeter borders 187, 189 of the extended ribs 186 along with the inside surface 111 form continuous parallel conduits 199. As an example, the first perimeter surface 183 of lower rib 182 and the third perimeter border 189 of the extended rib 186 along with the inside surface 111 forms continuous conduit 199*a* as shown in FIG. 6 and FIG. 7. As another example, the third perimeter surface 185 of lower rib 182 and the first perimeter border 187 of the extended rib 186 along with the inside surface 111 forms continuous conduit 199*b*.

Specifically, the lower ribs 182 and the extended ribs 186 of the nodular portion 180 alternate such that each of the first perimeter surface 183, the second perimeter surface 184, the third perimeter surface 185 of the lower ribs 182 and the first perimeter border 187, the second perimeter border 188, and the third perimeter border 189 of the lower rib 182 of the extended ribs 186 along with the inside surface 111 increase the surface area of the nodular portion 180.

The increased surface area provided by the alternating lower ribs 182 and extended ribs 186 facilitates a greater concentration of adhesive in the nodular portion 180 of the conduit structure 151. Specifically, the greater concentration of adhesive toward the first edge 113 of the main member 110 acts to prevent the safety nosing component 10 from detaching from an architectural structure including in instances when shoes or feet catch on the safety nosing component 10.

The planar portion 190 includes a projection 191 defined by a first face 192, a second face 193, and a third face 194. The second face 193 includes a plurality of equally spaced apart apertures 195. Each aperture 195 is created by the mold cavity as a result of securing the light emission element 300 and substrate element 200 during manufacturing. Specifically, the light emission element 300 and substrate element 200 are insert parts securely held in place by the mold cavity so that the light emission element 300 and substrate element 200 do not move when material is injected into the mold cavity to create the base element 100 which encapsulates the light emission element 300 and substrate element 200.

The apertures 195 provide an additional benefit by serving as ducts for receiving adhesive. Not only is adhesive applied to the second face 193 of the planar portion 190, but also received within the equally spaced apart apertures 195 to secure the safety nosing component 10 to an architectural structure.

The planar portion 190 further includes a continuous parallel rear conduit 197 formed by the third face 194 of the projection 191, wall 196, and the inside surface 111. The rear conduit 197 receives any overflow adhesive from the nodular portion 180 and planar portion 190 as well as further secures the main member 110 of the safety nosing component 10 to an architectural structure.

Figure 8:
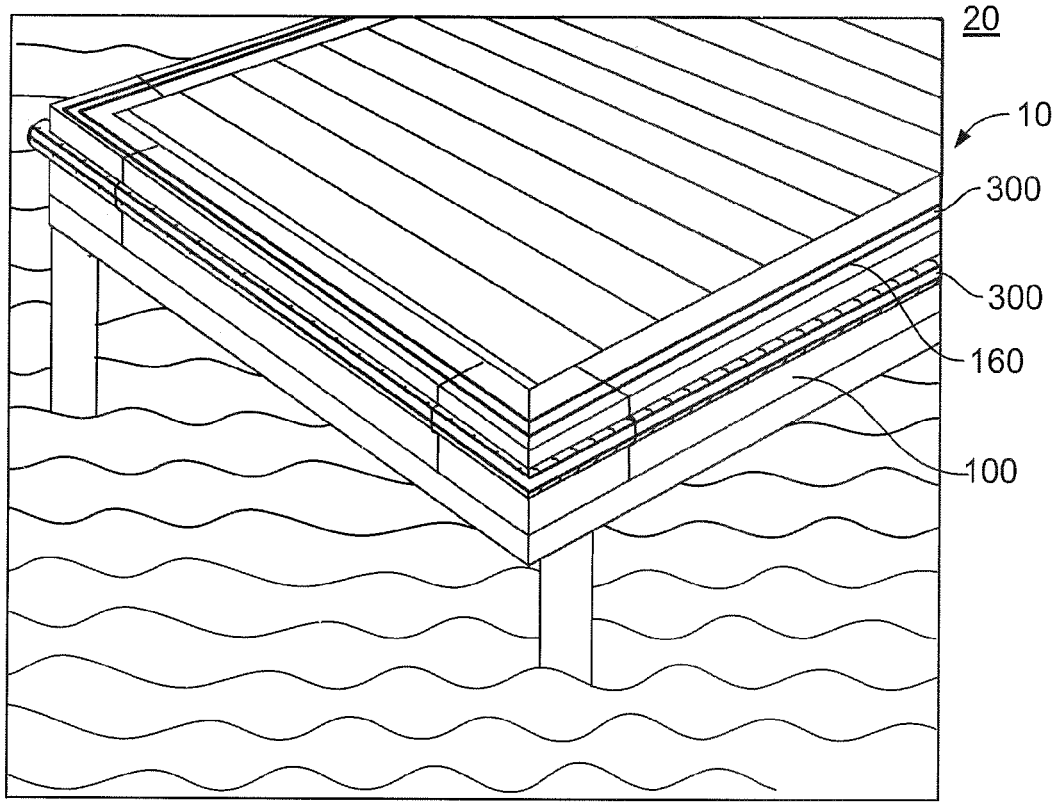
FIG. 8 is a perspective view of a safety nosing component shown as a dock nosing component in accordance with one embodiment of the present invention.

FIG. 8 is a perspective view of a safety nosing component 10 shown as a dock nosing component 20 in accordance with another embodiment of the present invention. In this embodiment, the dock nosing component 20 serves as a dock bumper and illumination guide for incoming water vessels. As shown more specifically in FIG. 9, the safety nosing component 10 includes a texture element 160 that is a dock bumper 162. The dock bumper 162 is positioned on the exterior surface 122 of the support member 120. In this embodiment, the dock bumper 162 includes a channel member 140 within which the light emission element 300 is positioned. The dock bumper 162 is manufactured from a soft pliable material that can cushion an impact, for example, such as thermoplastic polyurethanes (TPU), urethane, polyvinyl chloride (PVC) or other material.

Figure 10:
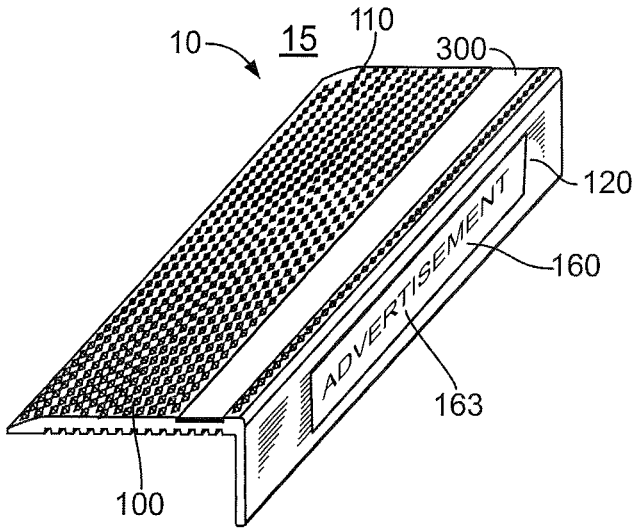
FIG. 10 is a perspective view of a safety nosing component with additional functionality of an advertising medium in accordance with an embodiment of the present invention.
Figure 11:
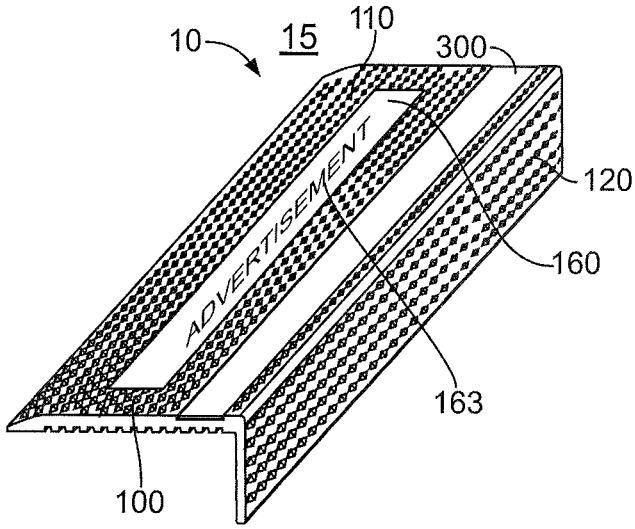
FIG. 11 is a perspective view of a safety nosing component with additional functionality of an advertising medium in accordance with another embodiment of the present invention.

FIG. 10 is a perspective view of a safety nosing component 10 with additional functionality of an advertising medium in accordance with an embodiment of the present invention. As shown in FIG. 10, the safety nosing component 10 includes a texture element 160 shown here as an advertising constituent 163. The advertising constituent 163 is positioned on the base element 100, more specifically on the exterior surface 122 of the support member 120 as shown, although it is also contemplated that the advertising constituent 163 may be positioned on the outside surface 112 of the main member 110 as shown in FIG. 11. It is also contemplated that the advertising constituent 163 is positioned on the upper face 301 of the light emission element 300 or even on the top face 201 of the substrate element 200.

Numerous embodiments of the advertising constituent 163 are contemplated. For example, in one embodiment, the advertising constituent 163 may be formed from the material to illustrate text such as a logo, or picture. In another embodiment, advertising constituent 163 may include a pocket into which a physical advertisement is located, such as using adhesive. The physical advertisement may be inserted, such as by sliding, within the pocket. The pocket may further include an upper lip and a lower lip to secure the physical advertisement. The pocket may even further include a clear cover to secure and protect the physical advertisement.

It will be understood that the embodiments of the present invention, which have been described, are illustrative of some of the applications of the principles of the present invention. Numerous modifications may be made by those skilled in the art without departing from the true spirit and scope of the invention.

The invention claimed is:

1. A safety nosing component for securement to a stair architectural structure, comprising:

a base element including a main member and a support member, the main member includes an inside surface, an outside surface, a first edge, a second edge, a third edge and a fourth edge;

the support member includes an interior surface, an exterior surface, a first border, a second border, a third border and a fourth border, wherein the main member and the support member unite at the second edge of the main member and the second border of the support member;

a texture element forming tread on the outside surface of the main member;

an attachment member on the inside surface of the main member, wherein the attachment member is a conduit structure including a nodular portion and a planar portion, the nodular portion including a plurality of continuous parallel lower ribs alternating between a plurality of continuous parallel extended ribs to form continuous parallel conduits, the planar portion including a projection and a continuous parallel rear conduit, the projection including a plurality of equally spaced apart apertures;

a channel member formed by a first boundary, a second boundary and a third boundary, wherein the channel member extends from a proximate end to a distal end and is positioned on the outside surface of the main member such that the proximate end terminates at the third edge of the main member and the distal end terminates at the fourth edge of the main member;

a substrate element, wherein the substrate element is of a flat-shaped cross-section including a top face, a bottom face, a first side, a second side, a third side and a fourth side; and a light emission element including an upper face, a lower face, a first wall, a second wall, a third wall and a fourth wall;

the substrate element and the light emission element are positioned within the channel member such that the bottom face of the substrate element abuts the first boundary of the channel member, the top face of the substrate element abuts the lower face of the light emission element and the upper face of the light emission element aligns with the outside surface of the main member, the third side of the substrate element aligns with the third wall of the light emission element and the third side and the third wall further align with the proximate end of the channel member, the fourth side of the substrate element aligns with the fourth wall of the light emission element and the fourth side and the fourth wall further align with the distal end of the channel member, the first side of the substrate element aligns with the first wall of the light emission element and the first side and the first wall substantially abut the second boundary of the channel member, and the second side of the substrate element aligns with the second wall of the light emission element and the second side and the second wall substantially abut the third boundary of the channel member, the attachment member on the inside surface of the main member facilitates assembly of the safety nosing component over an existing stair architectural structure, wherein adhesive is applied to the conduit structure and received within the at least one continuous conduit so that the safety nosing component directly assembles about and positively engages an existing stair architectural structure.

2. The safety nosing component for securement to a stair architectural structure of claim 1, wherein the first edge of the main member includes a bevel feature.

3. The safety nosing component for securement to an stair architectural structure of claim 1, wherein the substrate element is constructed of a material selected from the group comprising of a white polypropylene and a white polyethylene.

4. The safety nosing component for securement to a stair architectural structure of claim 1, wherein the base element is constructed of a material compounded with a glass fiber.

5. The safety nosing component for securement to an stair architectural structure of claim 1, wherein the base element is constructed of a material selected from the group comprising of polyurethane, polypropylene, and nylon-polypropylene alloy.

6. The safety nosing component for securement to a stair architectural structure of claim 1, wherein the texture element is a plurality of cleats.

7. The safety nosing component for securement to an stair architectural structure of claim 1, wherein the light emission element is between and including ½ inches to about and including 2½ inches in width.

8. The safety nosing component for securement to a stair architectural structure of claim 1 further comprising a texture element on the exterior surface of the support member.

9. The safety nosing component for securement to a stair architectural structure of claim 8, wherein the texture element is tread.

10. The safety nosing component for securement to a stair architectural structure of claim 8, wherein the texture element is an advertising constituent.

11. The safety nosing component for securement to a stair architectural structure of claim 1, wherein the texture element further comprises an advertising constituent.

12. The safety nosing component for securement to a stair architectural structure of claim 1, wherein the second boundary of the a channel member includes a first bevel feature and the third boundary of the channel member includes a second bevel feature, and the first side of the substrate element includes a first reverse bevel feature and the second side of the substrate element includes a second reverse bevel feature, and the first wall of the light emission element includes a third reverse bevel feature and the second wall of the light emission element includes a fourth reverse bevel feature, the first reverse bevel feature of the first side of the substrate element aligns with the third reverse bevel feature of the first wall of the light emission element and the first reverse bevel feature and the third reverse bevel feature mate with the first bevel feature of the second boundary of the channel member and the second reverse bevel feature of the second side of the substrate element aligns with the fourth reverse bevel feature of the second wall of the light emission element and the second reverse bevel feature and the fourth reverse bevel feature mate with the second bevel feature of the third boundary of the channel member such that the base element overmolds the substrate element and the light emission element thereby securing the substrate element and the light emission element within the channel member.

* * * * *